US005520958A

United States Patent [19]

Doesburg et al.

[11] Patent Number: 5,520,958

[45] Date of Patent: May 28, 1996

[54] SYSTEM AND METHOD FOR APPLYING A DESIRED, PROTECTIVE FINISH TO PRINTED LABEL STOCK

[75] Inventors: Eric J. Doesburg, Alpharetta; Marc L. Zirkle, Lawrenceville, both of Ga.

[73] Assignee: Nordson Corporation, Westlake, Ohio

[21] Appl. No.: 362,737

[22] Filed: Dec. 22, 1994

Related U.S. Application Data

[63] Continuation of Ser. No. 5,237, Jan. 15, 1993, abandoned.

[51] Int. Cl.[6] ..... B05D 1/26; B05D 3/12

[52] U.S. Cl. ..... 427/316; 427/359; 427/361; 427/365; 118/101; 118/118; 118/410

[58] Field of Search ..... 118/46, 101, 111, 118/112, 117, 118, 410, 60; 427/359, 361, 365, 316

[56] References Cited

U.S. PATENT DOCUMENTS

| | | | |
|---|---|---|---|
| 1,792,414 | 2/1931 | Cole | 118/46 |
| 3,349,749 | 10/1967 | Utschig | 118/101 |
| 3,385,721 | 5/1968 | Leach | 117/10 |
| 4,372,244 | 2/1983 | Rebel | 118/46 |
| 4,490,418 | 12/1984 | Yoshida | 427/445 |
| 4,612,152 | 9/1986 | Kawabata et al. | 264/136 |
| 4,805,544 | 2/1989 | McIntyre | 118/666 |
| 4,815,413 | 3/1989 | Kota | 118/46 |
| 4,848,268 | 7/1989 | Sollinger et al. | 118/227 |
| 5,033,403 | 7/1991 | Mladota | 118/410 |
| 5,039,560 | 8/1991 | Durgin et al. | 427/240 |

FOREIGN PATENT DOCUMENTS

| | | |
|---|---|---|
| 0210620A2 | 7/1986 | European Pat. Off. . |
| 2561548 | 3/1984 | France . |

OTHER PUBLICATIONS

Hawley, ed., The Condensed Chemical Dictionary, 1981, p. 1080.

*Primary Examiner*—Shrive Beck
*Assistant Examiner*—Katherine A. Bareford
*Attorney, Agent, or Firm*—Calfee Halter & Griswold

[57] ABSTRACT

A system and method are provided for applying a desired protective finish to a web of printed label stock. The web of printed label stock is moved through a coating station, where a layer of hot melt varnish is extruded onto the web of printed label stock. Then, the web of printed label stock is transferred to a working station in an environment which causes the layer of varnish to at least partially solidify to a predetermined state as it reaches the working station. At the working station, the layer of varnish is worked to a desired finish. Preferably the web is carried through a nip formed by a pair of rolls, including a highly polished chrome roll which contacts the layer of varnish and works the layer of varnish to a glossy finish. After the layer of varnish is worked to a glossy finish, the web is directed through a finishing station, where the glossy finish is fixed in the layer of varnish, and the web is conditioned to a state in which it can be processed as a web of finished label stock.

18 Claims, 2 Drawing Sheets

SYSTEM AND METHOD FOR APPLYING A DESIRED, PROTECTIVE FINISH TO PRINTED LABEL STOCK

This is a continuation of application Ser. No. 08/005,237 filed on Jan. 15, 1993, now abandoned.

TECHNICAL FIELD

The present invention relates to a system and method for applying a desired, protective finish to a web of printed paper stock, and particularly to a system for applying such a finish to a web of printed label stock.

BACKGROUND OF THE INVENTION

In the production of product labels, it is often desirable to print the labels in vivid, multi-color patterns that require high quality, multi-color printing systems. For example, a multi-color label printing system may comprise six or more printing stations. Each of the printing stations applies a printing ink in a single color (which may be a primary printing color or a special color blend) to a web of the paper stock. The printing inks applied by the plurality of printing stations collectively form a repetitive, multi-color label pattern on the web of paper stock.

In high quality, multi-color, label printing systems, it is known to dry each color printing ink after it is applied to the web, so that another color printing ink can be applied to the web without distorting the pattern of the ink applied at the earlier print stations. In order to dry the printing inks, it is known to direct the web through an oven or a curing station after each printing station. For example, if the different color printing inks used in the printing system are ultraviolet (UV) curable, the web of label stock is directed through a UV curing station after printing ink is applied at each of the printing stations.

It is known to apply a top protective finish coating to the printed label stock after the web of label stock has been printed (and the printing inks dried in the manner described above). The finish coating gives the printed label stock a desired finish, protects the printed label stock from damage or deterioration from ambient conditions, (e.g., moisture, sunlight, etc.), and resists scratching or abrasion of the printed label stock.

One known technique for applying a top, protective finish coating to printed label stock is to laminate a film of a transparent, protective material to a web of printed label stock. For example, it is known to superimpose a transparent film of a material such as Mylar® onto a web of printed label stock to form a laminate, and then heat cure the laminate, to fix the Mylar® film to the printed label stock. Also, it is known that some types of Mylar® film have pressure sensitive adhesive coated on one side thereof. Such types of Mylar® film can be laminated to a web of printed label stock by pressing the adhesive coated side of the Mylar® film against the web of printed label stock.

Applicants believe that laminating a Mylar® film to printed label stock is a relatively expensive way to apply a finish coating to the label stock, principally because Mylar® film is a relatively expensive material. Moreover, in order to change the thickness of the finish coating, it would be necessary to change the thickness of the Mylar® film which is laminated to the web of printed label stock. Thus, a label manufacturer would have to warehouse Mylar® film in as many different thicknesses as may be required (and as are available) to enable the label manufacturer to change the thickness of the film laminate. If Mylar® film is unavailable in certain desired thicknesses, that may be a significant limitation on a label manufacturer's flexibility to produce finish coatings in such thicknesses. Also, since the thickness of Mylar® film coated with pressure sensitive adhesive is affected by the thickness of the pressure sensitive adhesive, that may be another limitation on a label manufacturer's flexibility to produce finish coatings in different thicknesses. Thus, a label making system in which a Mylar® film laminate is used as a finish coating is not believed to be particularly flexible when it comes to adjusting the thickness of the finish coating. Furthermore, the equipment required for laminating a film of Mylar® to a web of printed label stock would be located primarily in the processing area of a label making plant, and that is a significant factor which would have to be taken into account in formulating a layout for the processing area of a label making plant.

Another known technique for applying a finish coating to a web of label stock is to apply a coating of radiation curable varnish, for example, ultraviolet ("UV") curable varnish, to the label stock, and to cure the varnish at a curing station. Moreover, since multicolor label printing systems are generally configured to dry the web after ink is applied at each printing station, it is known to use one of the printing stations to apply the UV curable varnish to the web of printed label stock, and then to direct the web through a UV curing station. If the printing system uses UV curable printing inks, the UV curing station may be the same curing station used for curing the printing inks.

Applicants believe that a label-making system utilizing a UV curable varnish as a finish coating has its own drawbacks. For example, applicants believe that curing time may be a drawback, because certain types of UV curable varnishes require significant amounts of curing time, in order to harden the varnishes. Moreover, some UV varnish curing systems generally require special venting system(s) for exhausting vapors and fumes associated with the removal of volatile solvents from the varnish during curing. Also, when a UV curable varnish is applied by one of the printing stations of a multi-color printing system, the system necessarily loses some of its color printing capabilities. That can be a significant problem, where a label maker requires the full use of a multi-color printing system to print a particular manufacturer's labels.

SUMMARY OF THE PRESENT INVENTION

The present invention discloses a new and useful system and method for providing a desired protective finish on a web of printed paper stock, particularly printed label stock.

A system according to the invention provides a desired protective finish coating to a web of printed label stock by (i) applying a protective layer of hot melt varnish, rather than a Mylar® film laminate or radiation cured topcoat, to the web of printed label stock, and (ii) working the layer of hot melt varnish to a desired finish. In comparison to a system which applies a Mylar® film laminate, a system according to the present invention is believed to be (i) more economical, in terms of the cost of the finish material, (ii) more flexible, in terms of the manner with which it can be adjusted to apply finish coatings of different thicknesses to a web of printed label stock, and (iii) in some instances more space efficient as to the use of the processing area of a label printing plant, because the hot melt varnish can be stored and melted at any location convenient to the label printing equipment, and only a relatively small part of the processing area of the plant used for the equipment which applies the protective finish coating to a web of printed label stock.

Moreover, in comparison to the type of system which applies a radiation cured topcoat (e.g., a UV cured varnish) at one of the printing stations, a system according to the present invention is specifically designed to apply the hot melt varnish to a web of printed label stock downstream of the multi-color printing system which prints the label stock. Thus, a system according to the present invention does not use one of the printing stations to apply the varnish to the printed label stock, and enables a multi-color printing system to be used to its maximum capability to print multi-colored label designs on the web of label stock. Still further, a system according to the invention produces a desired finish in a layer of varnish in less time than is required to cure many types of UV curable varnishes. Also, a system according to the invention does not require the types of equipment (and/or systems) which are often required for exhausting (ventilating) the solvents which are evaporated from UV curable varnishes during the curing process.

According to a preferred form of the present invention, a layer of hot melt varnish is applied to a web of printed label stock, preferably by extrusion through a slot die. Specifically, hot melt varnish is directed by a positive displacement metering pump to the slot die and is extruded through the head of the slot die. A transfer roll engages the unprinted side of the web of printed label stock, and carries the web of printed label stock at a relatively constant speed past the slot die. As the web of printed label stock is carried past the head of the slot die, a layer of hot melt varnish is extruded onto the printed side of the web of printed label stock. The slot die is oriented relative to the transfer roll such that the flow of hot melt varnish extruded through the slot die is substantially perpendicular to the web being moved past the slot die.

The thickness of the layer of varnish is determined by factors such as (i) the flow rate of varnish from the metering pump to the slot die, (ii) the speed at which the web is moved past the slot die, and (iii) the spacing between the slot die and the web. The thickness of the layer of varnish can be readily adjusted by changing (i) the flow rate of varnish from the metering pump to the slot die, (ii) the speed at which the web is moved past the slot die, and/or (iii) the spacing between the slot die and the web.

The web of printed label stock with the layer of hot melt varnish is then transferred to a working station, where a desired finish is produced in the layer of varnish. According to the preferred embodiment, a glossy finish is produced by a device which contacts the layer of varnish and works the layer of varnish to a glossy finish. Specifically, a highly polished chrome coated roll (referred to herein as a "highly polished chrome roll" or a "working roll") contacts the layer of varnish and works the layer of varnish to a glossy finish.

The web is transferred from the coating station to the working station in an environment which causes the hot melt varnish to at least partially solidify to a predetermined state by the time the layer of varnish reaches the working station. In that predetermined state, the layer of varnish is workable enough to develop the glossy finish by contact with the working roll, but solid enough so as not to adhere to the working roll and not to be extruded by pressure applied to the varnish by the working roll.

The working station preferably comprises a nip formed between the transfer roll and the working roll. The transfer roll, which engages the unvarnished side of the web, carries the web through the nip. The working roll is maintained at a temperature (e.g., about 20° C.) which is below ambient and which is substantially below the temperature at which the hot melt varnish was extruded onto the web of printed label stock.

The working roll contacts the layer of varnish in the partially solidified state as the web of printed label stock is carried through the nip. The working roll is rotated (driven) by its contact with the layer of varnish, and the contact pressure between the highly polished chrome surface of the working roll and the layer of varnish is such that the layer of varnish is worked to a desired finish. For example, with the preferred type of varnish used according to the invention, when the highly polished chrome working roll is being driven substantially at the speed of the layer of varnish, the working roll effectively casts its highly polished surface onto the layer of varnish, to produce a glossy finish in the layer of varnish. On the other hand, with different types of varnish formulations and/or different surface finishes on the working roll, it is believed possible to produce a desired satiny or even a desired dull finish in the layer of varnish.

After the desired finish is produced in the layer of varnish at the working station, the web of printed label stock is transferred to a finishing station, where the layer of varnish is fixed with the desired finish, and the web is conditioned to a state in which it can be processed as finished label stock. Preferably, the finishing station comprises a chill roll which (i) contacts the layer of varnish, (ii) chills the layer of varnish to a hardened state which fixes the desired finish in the layer of varnish, and (iii) withdraws sufficient heat from the web to condition the web to a state in which it can be processed as finished label stock.

A finish coating system according to the present invention is specifically designed to handle a hot melt varnish of a type which does not have a solvent (and thus does not require UV curing or drying of the varnish to evaporate solvent from the varnish). According to the present invention, the hot melt varnish is softened to a liquid-like state, extruded (through a slot die) onto the web, partially solidified by the environment in which the web of printed label stock is transferred to a working station, and then worked to a desired finish at the working station. A finish coating system according to the invention can be disposed downstream of, and in-line with, a multi-color printing system which can be used to its fullest capability to print the label stock.

Also, a finish coating system according to the present invention is capable of taking up relatively small portions of the processing area of a label making plant. Specifically, the equipment for storing, melting and directing the hot melt varnish to the coating station can be disposed at any location convenient to the printing system. The remaining components of the finish coating system, e.g., the slot die, the working station and the finishing station take up relatively modest amounts of the processing area of a label making plant. Thus, a finish coating system according to the present invention has the capability to be efficiently integrated into the processing area of a label making plant.

Additionally, a finish coating system and method according to the present invention, while primarily designed for applying a protective finish coating to printed label stock, may be useful in applying protective finish coatings to other types of web stock, (particularly printed web stocks formed of various types of paper stock).

Other features of the present invention will become further apparent from the following detailed description and the accompanying drawings.

DETAILED DESCRIPTION OF THE PREFERRED EMBODIMENT

Figure 1:
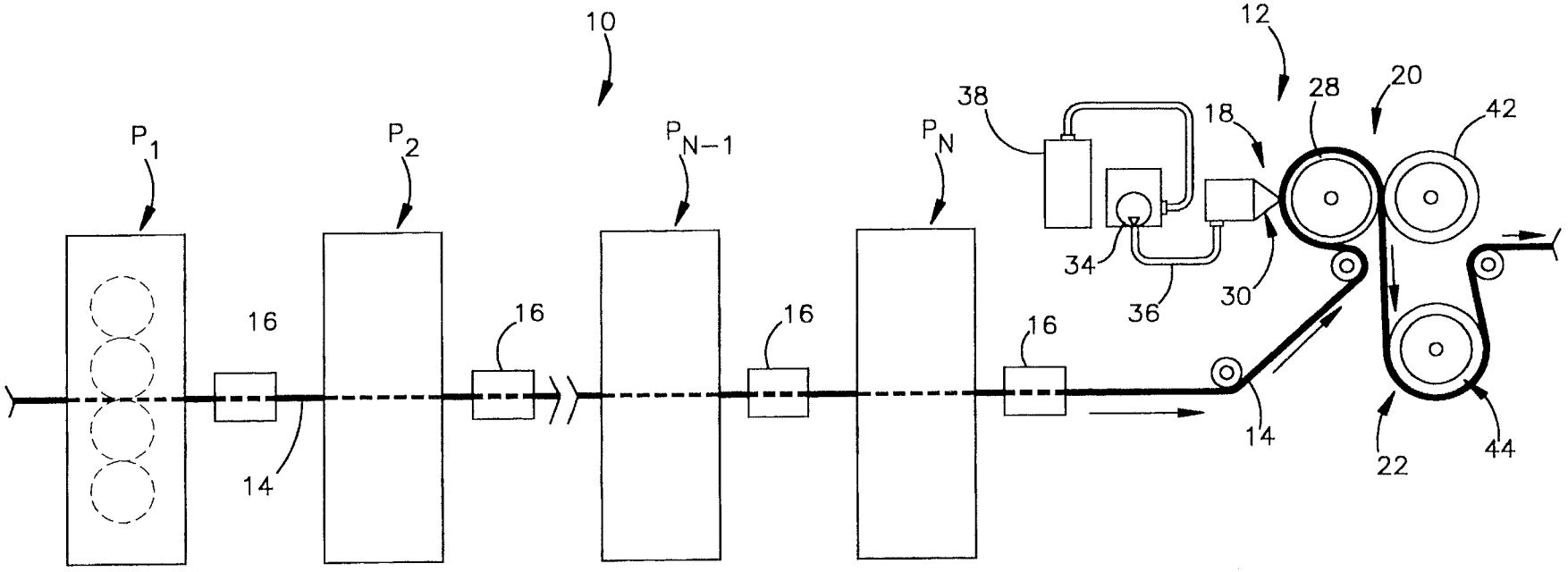
FIG. 1 is a schematic illustration of a label printing system, including a system for providing a printed label with a desired, protective finish according to the principles of the present invention.

As discussed above, the preferred embodiment of the present invention relates to a system and method for applying a protective, desired finish to a web of printed label stock. FIG. 1 schematically illustrates a label printing system 10, and a finish coating system 12, according to the invention, adapted to apply a protective, desired finish (preferably a glossy finish) to a web 14 of printed label stock. The finish coating system 12 is disposed in line with, and downstream of, the label printing system 10.

As illustrated in FIG. 1, the label printing system 10 comprises a series of printing stations $P_1$–$P_N$. The web 14, which is formed of paper stock, is directed through each of the printing stations $P_1$–$P_N$, and then through the finish coating system 12. At each printing station, ink of a single color (e.g. a primary printing color or, a special color blend) is applied to the web 14. When the web 14 has passed through all of the printing stations $P_1$–$P_N$, a repetitive, multi-color label pattern is printed on the web 14. Each of the printing stations $P_1$–$P_N$ can be of any known type (e.g., offset, flexo) for applying printing ink in a single color to a web of paper stock.

After ink of a single color is printed on the web 14 at one of the printing stations, the web passes through a web drying/curing station 16. The drying/curing station 16 drys, or cures, each color ink applied to the web 14, before the web 14 is directed through another printing station. The ink drying/curing station 16 would be of a known construction, designed to either dry, or cure, the particular type of printing ink applied to the web at the printing stations $P_1$–$P_N$. For example, if the printing ink is a water based printing ink, the drying/curing station 16 would preferably comprise an oven which dries the printing ink. On the other hand, if the printing ink is a UV curable printing ink, the drying/curing station 16 would comprise a UV curing station which applies ultraviolet radiation to the printing ink, to cure the ink. With many printing inks, it is necessary to provide exhaust or ventilating equipment for removing volatile solvents which are removed from the inks during drying or curing.

After being printed with the repetitive multicolor label patterns, the web 14 of printed label stock is directed to the finish coating system 12. At the finish coating system 12, a finish coating comprising a protective coating with a glossy finish is applied to the web 14 of printed label stock. The finish coating (i) provides a desired glossy finish to the web of printed label stock, (ii) protects the web of printed label stock from damage or deterioration from ambient conditions, and (iii) protects the web of printed label stock from scratches or abrasions. Moreover, if the label stock used in certain types of packaging (e.g., food packaging), the finish coating may also provide a barrier which resists passage of odors through the packaging.

The finish coating system 12 comprises (i) a coating station 18 at which the web 14 of printed label stock is coated with a layer of hot melt varnish, (ii) a working station 20 at which the layer of varnish is worked to a smooth, glossy finish, and (iii) a finishing station 22 at which the glossy finish is fixed in the layer of varnish, and the web 14 is conditioned to a state in which it can be processed as finished label stock. The web 14 is transferred from the coating station 18 to the working station 20 in an environment in which the layer of varnish partially solidifies to a predetermined state when the layer of varnish reaches the working station 20. In that predetermined state, the layer of varnish is pliable enough to be worked to a glossy finish by contact with a working device, but solid enough so as not to adhere to the working device or to be extruded by contact with the working device.

The coating station 18 comprises a coating apparatus 26 which extrudes a layer of a hot melt varnish onto the web 14, and a silicone coated transfer roll 28 which carries the web 14 past the coating apparatus 26. The coating apparatus 26 is preferably a Nordson Model EP-51-2 slot die apparatus made by Nordson Corporation, 28601 Clemens Road, Westlake, Ohio, 44145-1148. Such slot die apparatus has heretofore been used for extruding hot melt adhesive onto a substrate, and applicants have found that it can be designed to apply a substantially streakless coating of hot melt varnish to a web of printed label stock. The slot die apparatus includes (i) a slot die 30 through which a layer of hot melt varnish is extruded onto the web 14, (ii) a hot melt applicator tank 32 in which the varnish is melted to a substantially liquid state, (iii) a positive displacement, metering gear pump 34 which is located in the manifold of tank 32 and which pumps a metered amount of the melted varnish from the hot melt applicator tank 32, and (iv) a flexible conduit 36 which directs the molten varnish to the slot die 30. The metering gear pump 34 can be driven at a substantially constant speed, to pump a metered amount of molten varnish, at a substantially constant flow rate, to the slot die 30. The speed of the metering gear pump 34 can be selectively changed, to change the rate of flow of varnish to the slot die 30. A metering device (not shown), of a type which is well known for metering hot melt adhesives, can be placed in the conduit 36 which directs the molten varnish to the slot die 30, to further meter the amount of molten varnish directed to the slot die 30. Preferably, the hot melt applicator tank 32 comprises a Nordson Model 6000 hot melt applicator tank, which is a known type of hot melt applicator tank for use with hot melt adhesives. Further, a combined drum melter/drum unloader 38, also of known construction for use with hot melt adhesives, may be provided, if desired, for feeding a supply of the hot melt varnish from a storage drum (not shown) to the melt applicator tank 32.

Figure 2:
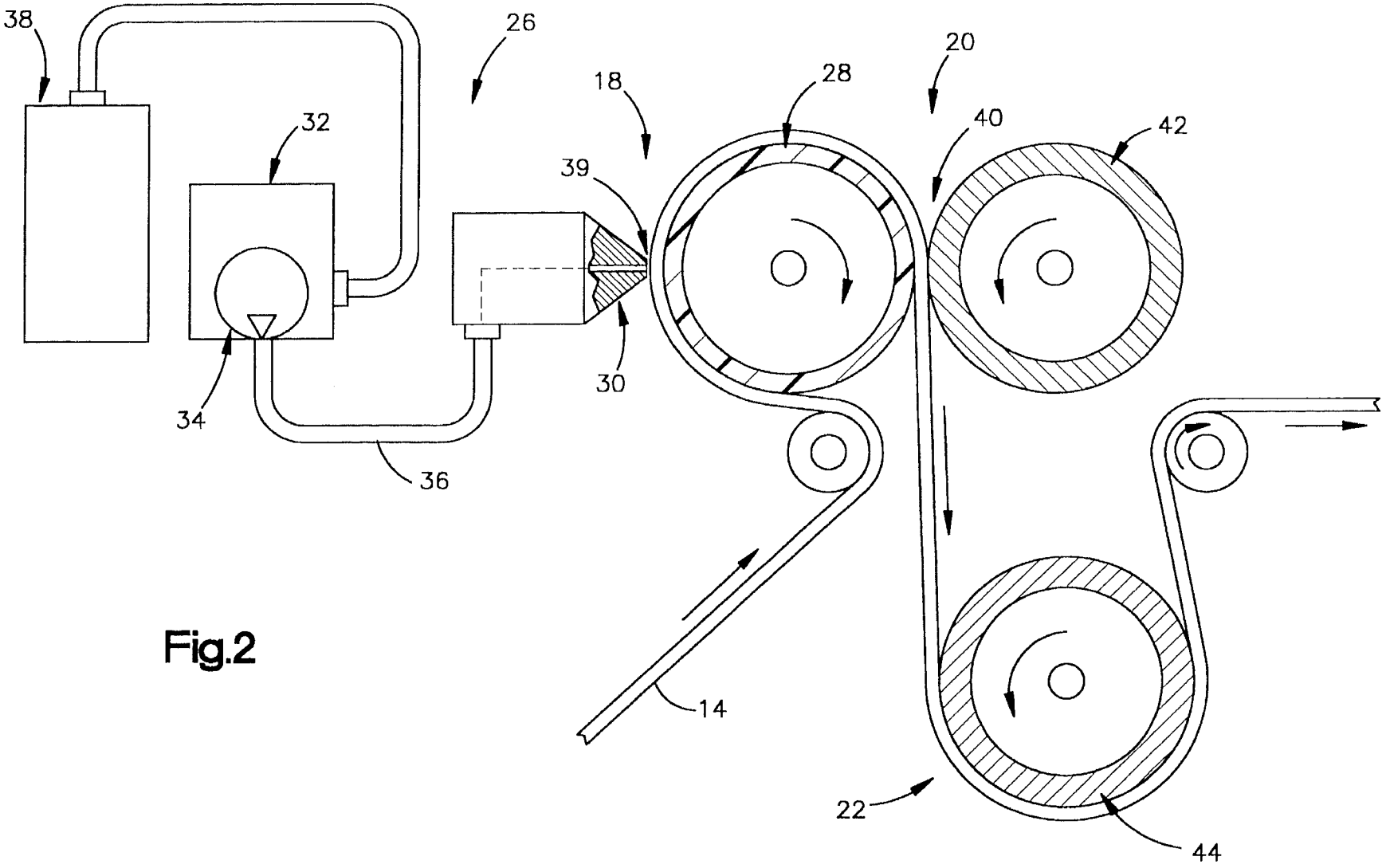
FIG. 2 is a schematic illustration of the components of a system for applying a desired, protective finish to a web of printed label stock, according to the principles of the present invention.

The slot die 30 includes a mouth 39 (FIG. 2), through which the molten varnish is directed onto the web 14, as the web 14 is moved past the slot die 30. The web 14 is wrapped around a substantial portion of the transfer roll 28, (i.e. approximately 270° about the transfer roll) with the unprinted side of the web 14 in contact with the transfer roll 28. The slot die 30 is oriented relative to the transfer roll 28 such that molten varnish is extruded through the slot die 30 in a direction which is substantially perpendicular to the web 14 being moved by the transfer roll 28 past the slot die 30. The transfer roll 28 is positively rotated at a selected speed by known drive means (not shown), to move the web 14 past the slot die 30 at a predetermined constant speed. The speed of rotation of the transfer roll 28 can be selectively changed, to change the speed at which the web 14 is moved past the slot die 30. The slot die 30 is supported by bracketry of known construction, e.g., Nordson model "NT" bracketry (not shown), which allows the mouth 39 of slot die 30 to be maintained at a predetermined distance from the web 14, but which allows the distance between the mouth 39 of the slot die 30 and the web 14 to be selectively adjusted.

The thickness of the layer of varnish is determined by factors such as (i) the flow rate of varnish from the metering gear pump 34 to the slot die 30, (ii) the speed at which the web 14 is moved past the slot die 30 by the transfer roll 28, and (iii) the spacing between the slot die 30 and the web 14. The thickness of the layer of varnish can be readily adjusted by changing (i) the flow rate of varnish from the metering pump 34 to the slot die 30, (ii) the speed at which the web 14 is moved past the slot die 30, and/or (iii) the distance between the mouth of the slot die 30 and the web 14.

The preferred version of slot die 30 (i.e., the Nordson Model EP-51-2) is capable of applying a substantially streakless layer of a hot melt adhesive to a substrate. According to the present invention, it is believed that to use such a slot die to provide a substantially streakless coating of hot melt varnish to a web of printed label stock, it may be useful to coat the mouth 39 of the slot die 30 with a layer of chrome which is then polished to a very fine finish that resists abrasion of the mouth 39 from any particulate matter which may be carried by the web 14 of printed label stock.

An alternative form of slot die which is contemplated for the present invention is a Nordson Model BC-40 slot die. Such a slot die has been heretofore used to apply a substantially streakless layer of hot melt adhesive to a substrate, and applicants believe it can be used to apply a substantially streakless coating of hot melt varnish to a web of printed label stock. The slot die includes a roll bar at the mouth of the slot die which continually removes any varnish which might otherwise build up in the mouth, thereby to provide a substantially streakless coating of hot melt varnish, to the web 14 of printed label stock.

The hot melt varnish which is extruded through the slot die 30 is preferably a hot melt varnish material made by Swift Adhesives, 3100 Woodcreek Drive, P.O. Box 1546, Downers Grove, Ill. 60515 and having the product designation 2H195. The hot melt varnish (i) is substantially solid at ambient temperature, (ii) has a softening point of about 230° F., (iii) can be melted to a substantially liquid state and extruded through the slot die 30 and onto the web 14 at about 350° F. and (iv) will partially solidify to a predetermined state after being applied to the web 14 and transferred a predetermined distance on the web 14 in a substantially ambient atmosphere by a transfer roll whose temperature is about 125° F. Also, the hot melt varnish has no solvents which are released or evaporated therefrom as the varnish is melted, extruded onto the web or further processed according to the principles of the present invention. Thus, application and processing of the varnish, in accordance with the principles of the present invention, does not require the types of exhaust or ventilation systems frequently associated with UV curable varnishes. It is believed that the preferred hot melt varnish is a version of a hot melt varnish that was produced by Swift Adhesives and previously used in certain coating operations which did not involve extrusion. Moreover, it is believed the varnish was discontinued by Swift Adhesives in the late 1970's, and has been placed back in production by Swift Adhesives in response to the interest in the varnish shown by the assignee of this invention (that interest has been motivated by the applicants' discovery that the varnish can be extruded onto printed label stock and worked to produce a desired protective finish to the printed label stock, in accordance with the present invention).

The hot melt varnish is extruded (at a predetermined flow rate) onto the printed side of the web 14 as the transfer roll 28 carries the web 14 at a preselected speed past the slot die 30. Preferably, the web 14 is substantially perpendicular to the slot die 30 as the web 14 is carried past the slot die 30. The temperature of the varnish as it is extruded onto the web 14 is approximately 350° F. Thus, the paper stock which forms the web 14 must, in addition to being compatible with the printing inks (in terms of producing a desired print quality), be capable of withstanding the temperature of the varnish which is extruded onto the web, without any significant degradation or distortion of the paper stock.

After the varnish is extruded onto the web 14, the transfer roll 28 transfers the web 14 to the working station 20. The working station 20 includes a nip 40 formed between the transfer roll 28 and a highly polished chrome coated roll 42 (also referred to herein as a "highly polished chrome roll" or a "working roll"). The web 14 is wrapped about the transfer roll 28 to a great enough extent (about 270°) such that the transfer roll 28 not only carries the web 14 from the coating station 18 to the working station 20 but also carries the web through the nip 40.

As the web 14 is transferred from the coating station 18 to the working station 20, the layer of varnish partially solidifies to a predetermined state in which it is (i) pliable enough to be worked to a glossy finish by contact with the highly polished chrome roll 42, but (ii) solid enough so as not to be extruded or to adhere to the highly polished chrome roll 42 as the web 14 with the layer of varnish is carried through the nip 40. The environment in which the layer of varnish is transferred from the coating station 18 to the working station 20 is determined by factors such as (i) the temperature of the transfer roll 28, (ii) the length of the path of travel of the layer of varnish from the coating station 18 to the working station 20, and (iii) the temperature of the atmosphere about the layer of varnish. As can be seen by the Figures, the web 14 is transferred by the transfer roll 28 about 180° about the periphery of the transfer roll 28 before the layer of varnish enters the nip 40. The temperature of the transfer roll 28 is about at 125° F., and the temperature of the atmosphere around the layer of varnish is about at ambient as the layer of varnish is being transferred from the coating station 18 to the nip 40. Such an environment enables the varnish to partially solidify to the predetermined state by the time the layer of varnish reaches the nip 40.

At the working station 20, the web is carried through the nip 40 by the transfer roll 28. The transfer roll 28 contacts the unvarnished side of the web 14, and the highly polished chrome roll 42 contacts the layer of varnish on the printed side of the web 14 and works the layer of varnish to a desired finish as the layer of varnish is carried through the nip 40. The highly polished chrome roll 42 is maintained at a temperature (about 20° C.) which is below ambient, and is driven by contact with the layer of varnish passing through the nip 40. The configuration of the nip 40 is designed to produce a predetermined level of contact pressure between the highly polished chrome roll 42 and the layer of varnish as the web 14 is carried through the nip 40, to produce the desired glossy finish to the layer of varnish.

With the preferred type of varnish, and a highly polished chrome roll with a surface finish described in the finish coating system below, the highly polished chrome roll 42 is driven substantially at the speed of the layer of varnish, and effectively casts its highly polished surface onto the layer of varnish, to produce a glossy finish in the layer of varnish. On the other hand, with different types of varnish formulations and/or different surface finishes on the working roll, it is believed possible to produce a desired satiny or even a desired dull finish in the layer of varnish. Also, it is recognized that there may be slippage between the working roll and the layer of varnish. For example, if the layer of varnish is moving at a constant speed, slippage can occur at start up (due to the inertia of the working roll) and some slippage might occur during normal operation (due to drag caused by friction in the bearings of the working roll). Further, slippage can be caused by changes in the speed at which the layer of varnish is carried through the nip. Slippage between the working roll and the layer of varnish can have the additional effect of polishing the layer of varnish to some degree as the layer of varnish is being worked to a glossy finish.

Applicants believe that for the preferred type of hot melt varnish, a desirable level of glossy finish can be produced on printed label stock with a finish coating system having the following characteristics:

Slot coating head: Nordson Model EP-51-2 with a polished layer of chrome on the mouth thereof;

Transfer roll: Silicon coated roll having a diameter of about 6";

Transfer path between coating station and nip:

About 180° about transfer roll;

Highly polished chrome roll: diameter 6";

Roll temperature: 20° C.

Roll Construction: 1018 steel

Runout+0.0002" RMS 12–16

Hard Chrome Finish: 0.0004"–0.0006"thickness, 60–65 Rockwell;

Transfer roll temperature: About 125° F.;

Contact pressure(s) at nip: normal contact pressure of about 45 psig and lineal contact pressure of about 35.35 lbs/lineal inch;

Adhesive: Swift Adhesives product number 2H195, with softening temperature of about 230° F.;

EP-51-2 Slot Opening: 0.010";

Distance between slot die mouth and transfer roll:

<0.001";

Web speed: substantially constant, and in the range of 25–200 fpm.

After the web passes through the working station 20, it is transferred to the finishing station 22. At the finishing station 22, a driven chill roll 44 (which is maintained at about 5° C.) contacts the layer of varnish to harden (or fix) the varnish with its glossy finish and to condition the web 14 to a state where it can be further processed as finished label stock. The chill roll 44 is of a known construction, and is driven by conventional means (not shown) in a manner which moves the web 14 at a predetermined speed. Preferably, the varnished side of the web 14 is wrapped about 220° around the chill roll 44 (see FIG. 2). The chill roll 44 is maintained at a temperature (e.g., about 5° C.) that causes all remaining heat to be substantially extracted from the layer of varnish, so that the varnish is fixed and hardened with its glossy finish and sufficient heat is removed from the web 14 to drop the temperature of the web to its original temperature, thereby to allow the web 14 to be subsequently processed as finished label stock.

Thus, according to the preferred version of the invention, a desired protective finish is applied to a web of printed label stock by the steps of (i) extruding a layer of hot melt varnish onto the web, (ii) transferring the web to a working station in an environment which causes the varnish to partially solidify to a predetermined state, (iii) working the partially solidified layer of varnish to a glossy finish, and then (iv) fixing the glossy finish in the layer of varnish and conditioning the web to a state in which it can be processed as finished label stock. With a system according to the invention, the hot melt varnish can be stored and melted at any location convenient to the label printing equipment, and only a relatively small part of the processing area of a label printing plant used for the equipment which applies the finish coating to a web of printed label stock. Moreover, the system is flexible, in terms of the manner in which its components (e.g., the ratio of the varnish flow rate and the web speed and/or the spacing of the slot die from the transfer roll) can be adjusted in order to change the thickness of the layer of varnish applied to the web.

With the foregoing description in mind, it is believed that various modifications of the disclosed system and method will become readily apparent to those of ordinary in the printing and coating arts.

We claim:

1. A method of applying a protective finish to a web of paper stock, comprising the steps of:

a. heating a back side of the web of paper stock prior to moving the web of paper stock through a coating station;

b. coating a top side of the web of paper stock with a layer of a hot melt varnish as the web of paper stock moves through the coating station;

c. transferring the coated web of paper stock away from the coating station and to a working nip in an environment which causes the layer of varnish to at least partially solidify as it reaches the working nip;

d. moving the coated web of paper stock past the working nip while working the layer of varnish to a top protective finish;

e. subsequently moving the web of paper stock away from the working nip to a finishing station; and f. contacting and chilling the worked layer of varnish as the web of paper stock moves through the finishing station to fix the finish in the layer of varnish.

2. A method as set forth in claim 1, wherein said step of coating said top side of the web of paper stock comprises extruding a layer of hot melt varnish onto only one side of the web of paper stock.

3. A method as set forth in claim 1, wherein said step of working the layer of varnish to a top protective finish comprises the step of working the layer of varnish to a substantially glossy finish.

4. A method as set forth in claim 3, wherein said nip is formed by a transfer roll and a polished chrome roll and said step of working the layer of varnish to a top protective finish comprises the step of contacting the layer of varnish with the polished chrome roll as the layer of varnish moves past the working nip.

5. A method as set forth in claim 4, wherein said step of working the layer of varnish to a top protective finish comprises maintaining the polished chrome roll at a temperature of about 20° C. and the transfer roll at about 175° F. as the web of paper stock moves past the working nip.

6. A method as set forth in claim 5, wherein said web of paper stock comprises a web of printed label stock.

7. A method of applying a protective finish to a web of printed label stock, comprising the steps of:

a. heating a back side of the web of printed label stock prior to moving the web of printed label stock through a coating station;

b. coating a top side of the web of printed label stock with a layer of a hot melt varnish as the web of printed label stock moves through the coating station;

c. transferring the coated web of printed label stock away from the coating station and to a working nip in an environment which causes the layer of varnish to at least partially solidify as it reaches the working nip;

d. moving the coated web of printed stock past the working nip while working the layer of varnish to a top protective finish;

e. subsequently moving the web of printed label stock away from the working nip to a finishing station; and f. contacting and chilling the worked layer of varnish as the web of printed label stock moves through the finishing station to fix the finish in the layer of varnish.

8. (three times amended) A method as set forth in claim 7, wherein said step of coating said top side of the web of printed label stock comprises extruding a layer of hot melt varnish onto only one side of the web of printed label stock.

9. A method as set forth in claim 7, wherein said step of working the layer of varnish to a top protective finish comprises the step of working the layer of varnish to a substantially glossy finish.

10. A method as set forth in claim 9, wherein said nip is formed by a transfer roll and a polished chrome roll and said step of working the layer of varnish to a top protective finish comprises the step of contacting the layer of varnish with the polished chrome roll as the layer of varnish moves past the working nip.

11. A method as set forth in claim 10, wherein said step of working the layer of varnish to a top protective finish comprises maintaining the polished chrome roll at a temperature of about 20° C. and the transfer roll at about 175° F. as the web of printed label stock moves past the working nip.

12. A method as set forth in claim 11, wherein said web of printed label stock comprises a web of printed paper stock.

13. A method of applying a protective finish to a web of paper stock, comprising the steps of:

a. moving the web of paper stock through a coating station;

b. coating one side of the web of paper stock with a layer of a hot melt varnish as the web of paper stock moves through the coating station, by extruding a layer of hot melt varnish onto only one side of the web of paper stock;

c. transferring the coated web of paper stock away from the coating station and to a working nip formed by a transfer roll and a polished chrome roll in an environment which causes the layer of varnish to at least partially solidify as it reaches the working nip;

d. moving the coated web of paper stock past the working nip while working the layer of varnish to a top protective substantially glossy finish by establishing contact pressure between the polished chrome roll and the layer of varnish as the layer of varnish moves past the working nip, and driving the polished chrome roll solely by its contact with the layer of varnish as the web of paper stock moves past the working nip, while positively driving the transfer roll;

e. subsequently moving the web of paper stock away from the working nip to a finishing station; and f. contacting and chilling the worked layer of varnish as the web of paper stock moves through the finishing station to fix the finish in the layer of varnish.

14. A method as set forth in claim 13, wherein said step of working the layer of varnish to a top protective finish comprises maintaining the polished chrome roll at a temperature of about 20° C. and the transfer roll at about 175° F. as the web of paper stock moves past the working nip.

15. A method as set forth in claim 14, wherein said web of paper stock comprises a web of printed label stock.

16. A method of applying a protective finish to a web of printed label stock, comprising the steps of:

a. moving the web of printed label stock through a coating station;

b. coating one side of the web of printed label stock with a layer of a hot melt varnish as the web of printed label stock moves through the coating station, by extruding a layer of hot melt varnish onto only one side of the web of printed label stock;

c. transferring the coated web of printed label stock away from the coating station and to a working nip formed by a transfer roll and a polished chrome roll in an environment which causes the layer of varnish to at least partially solidify as it reaches the working nip;

d. moving the coated web of printed stock past the working nip while working the layer of varnish to a top protective substantially glossy finish by establishing contact pressure between the polished chrome roll and the layer of varnish as the layer of varnish moves past the working nip, and driving the polished chrome roll solely by its contact with the layer of varnish as the web of printed label stock moves past the working nip, while positively driving the transfer roll;

e. subsequently moving the web of printed label stock away from the working nip to a finishing station; and f. contacting and chilling the worked layer of varnish as the web of printed label stock moves through the finishing station to fix the finish in the layer of varnish.

17. A method as set forth in claim 16, wherein said step of working the layer of varnish to a top protective finish comprises maintaining the polished chrome roll at a temperature of about 20° C. and the transfer roll at about 175° F. as the web of printed label stock moves past the working nip.

18. A method as set forth in claim 17, wherein said web of printed label stock comprises a web of printed paper stock.

* * * * *